US006213580B1

(12) United States Patent
Segerstrom et al.

(10) Patent No.: US 6,213,580 B1
(45) Date of Patent: Apr. 10, 2001

(54) APPARATUS AND METHOD FOR AUTOMATICALLY ALIGNING PRINT HEADS

(75) Inventors: Eric C. Segerstrom, Portland; Paul A. Boeschoten, Canby; Ronald F. Burr, Wilsonville; Chad J. Slenes, Tigard, all of OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/030,672

(22) Filed: Feb. 25, 1998

(51) Int. Cl.[7] ..... B41J 29/393
(52) U.S. Cl. ..... 347/19
(58) Field of Search ..... 347/19; 400/59

(56) References Cited

U.S. PATENT DOCUMENTS

| | | | | |
|---|---|---|---|---|
| 4,907,018 | | 3/1990 | Pinkerpell et al. . | |
| 4,940,998 | | 7/1990 | Asakawa . | |
| 5,241,325 | * | 8/1993 | Nguyen . | |
| 5,389,958 | * | 2/1995 | Bui et al. | 347/103 |
| 5,428,375 | | 6/1995 | Simon et al. | 347/12 |
| 5,451,990 | * | 9/1995 | Sorenson et al. | 347/37 |
| 5,475,409 | | 12/1995 | Simon et al. | 347/74 |
| 5,477,254 | * | 12/1995 | Stephens | 347/74 |
| 5,488,397 | | 1/1996 | Nguyen et al. | 347/40 |
| 5,534,895 | | 7/1996 | Lindenfelser et al. | 347/19 |
| 5,592,202 | | 1/1997 | Erickson | 347/37 |
| 5,677,719 | | 10/1997 | Granzow | 347/103 |
| 5,696,541 | * | 12/1997 | Akahane et al. | 347/8 |
| 5,717,451 | | 2/1998 | Katano et al. | 347/242 |
| 5,751,311 | * | 5/1998 | Drake | 347/43 |

FOREIGN PATENT DOCUMENTS

| | | |
|---|---|---|
| 0 539 812 A2 | 5/1993 | (EP) . |
| 0 674 993 A2 | 10/1995 | (EP) . |

* cited by examiner

*Primary Examiner*—David F. Yockey
*Assistant Examiner*—Alfred Dudding

(57) ABSTRACT

An apparatus and related method for automatically aligning one or more print head modules in an ink jet printing system are provided. A mounting supports and aligns a print head module with respect to three axes of movement. The mounting includes rotatable cams that contact control surfaces connected to the print head module to move the print head module in a desired direction. The related method automatically positions multiple stationary print heads with respect to three axes of movement, including rotational adjustment about a Z-axis. The method also automatically adjusts the position of a single print head with respect to its angular rotation about the Z-axis.

26 Claims, 9 Drawing Sheets

APPARATUS AND METHOD FOR AUTOMATICALLY ALIGNING PRINT HEADS

FIELD OF INVENTION

This invention relates generally to an apparatus and method for automatically aligning one or more print heads in an ink jet printing system and, more specifically, to an apparatus and method that automatically positions multiple stationary print heads with respect to three axes of movement.

BACKGROUND OF THE INVENTION

Ink jet printing involves ejecting ink droplets from orifices in a print head onto a receiving substrate to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly utilize either direct printing or offset printing architecture. In a typical direct printing system, ink is ejected from jets in the print head directly onto the final receiving substrate. In an offset printing system, the print head jets the ink onto an intermediate transfer surface, such as a liquid layer on a drum. The final receiving substrate is then brought into contact with the intermediate transfer surface and the ink image is transferred and fused or fixed to the substrate.

In many direct and offset printing systems, the print head and the final receiving substrate or the intermediate transfer surface move relative to one another in two dimensions as the print head jets are fired. Typically, the print head is translated along an X-axis in a direction perpendicular to media travel (Y-axis). The final receiving substrate/intermediate transfer surface is moved past the print head along the Y-axis. In this manner, the print head "scans" over the medium/substrate and forms a dot-matrix image by selectively depositing ink drops at specific pixel locations. To increase image density and allow for greater speeds, multiple print heads may be utilized.

Image resolution, print quality and speed are among the most important considerations in designing a printing system. Where greater speeds are paramount, it is known to utilize one or more stationary print heads to eliminate the necessity of scanning across the transfer surface or media. Multiple stationary print heads increase speeds while also allowing for greater image density and increased image width.

One challenge with a multiple print head architecture, whether scanning or stationary, is to maintain proper alignment among the print heads. If one print head is misaligned relative to the other print heads in the array, printing artifacts such as banding and misregistration can occur. Additionally, whenever a print head is installed in the print head array, it must be precisely aligned with the other print heads.

Alignment among multiple print heads may be expressed as the position of one print head relative to another print head within a coordinate system of multiple axes. For purposes of discussion, the X-axis will refer to a direction perpendicular to the media/intermediate transfer surface travel direction past a print head, the Y-axis will refer to a direction parallel to the media travel direction and the Z-axis will refer to a direction perpendicular to the X-Y axis plane. It will be appreciated that in this three dimensional coordinate system, a print head has six degrees of freedom of movement—three degrees of freedom of translation along the X, Y and Z axes, and three degrees of freedom of rotation about the three axes.

For optimal placement of ink drops on the receiving substrate, each print head in a multiple print head system should be aligned with the other print heads with respect to all six degrees of freedom of movement. It will be noted, however, that the printed image is a two-dimensional pattern of pixels arranged in the X-Y plane on the receiving substrate. Thus, the alignment of the print heads with respect to their position along the X and Y-axes and their angular rotation or roll about the Z-axis, also referred to as θ, will have the most impact on print quality and printing artifacts.

Prior art multiple print head systems have disclosed alignment mechanisms that utilize operator input to perform print head alignment along two axes. For example, in U.S. Pat. No. 5,428,375 to Simon et al. (the '375 patent), each print head is supported by a platform that carries X and Y translation actuators. The X translation actuator moves the platform along a fixed lead screw in an X-axis direction. The Y translation actuator drives a plunger back and forth to move the platform in a Y-axis direction. An operator examines output from the printer for visual artifacts and manually adjusts the X and Y actuators to reposition the print heads. This mechanism does not allow for adjustment of individual print head "roll" or θ correction.

U.S. Pat. No. 5,241,325 to Nguyen (the '325 patent) discloses a scanning or "swath type" printer that includes a mechanism for aligning two print cartridges with respect to a single axis of movement. One print cartridge is mounted in a fixed-position retaining shoe and the other print cartridge is mounted in a pivoting retaining shoe. Both retaining shoes are mounted on a carriage that scans across the media in an X-axis direction.

The print cartridges print test lines and an optical scanner measures the distance between test line segments. Horizontal or X-axis misalignment between the two print cartridges is addressed by adjusting the timing of the ink jet nozzle firing as the cartridges scan across the media. Vertical or Y-axis misalignment is addressed by nozzle selection and by mechanically adjusting the angular position about the X-axis of the adjustable retaining shoe relative to the fixed-position retaining shoe.

The mechanical adjustment is performed by advancing the print cartridges along the X-axis until a cam lever on the carriage engages an actuator arm. Movement of the cam lever rotates a position adjustment cam that bears against a cam follower flange on the adjustable retaining shoe. This rotates the adjustable retaining shoe and associated print cartridge about the X-axis while the fixed-position shoe and cartridge remain stationary.

One drawback to the adjustment mechanism in the '325 patent is that it is limited to scanning or "swath type" printing systems, as movement of the print cartridges in the X-axis direction is required to actuate the mechanism. This mechanism is also limited to rotational adjustments about the X-axis. Additionally, like the mechanism in the '375 patent, the mechanism in the '325 patent does not allow for adjustment of print head "roll" or θ correction.

The present invention addresses the drawbacks of the prior art by providing an apparatus and method for automatically adjusting the relative position of multiple print heads with respect to three axes of movement, including rotational or θ adjustment about the Z-axis. The present invention also provides a method for automatically adjusting the position of a single print head with respect to its angular rotation about the Z-axis.

SUMMARY OF THE INVENTION

It is an aspect of the present invention to provide a method and apparatus for automatically aligning individual print heads within an array of print heads with respect to three axes of movement.

It is another aspect of the present invention that the method and apparatus may be utilized with direct and indirect or offset printing architectures.

It is another aspect of the present invention that the method and apparatus may be implemented in printing systems using scanning and fixed-position print heads.

It is a feature of the present invention that the method and apparatus allow an operator to replace individual print heads in an array of print heads without manually adjusting the alignment of the print heads.

It is another feature of the present invention that the method aligns multiple print heads with respect to a reference print head in the array.

It is yet another feature of the present invention that the method and apparatus may be utilized with any number of print heads in an array.

It is an advantage of the present invention that the method is a closed-loop electromechanical system that requires no input or intervention by an operator.

It is another advantage of the present invention that the method and apparatus align multiple print heads along an X-axis and Y-axis and rotationally about a Z-axis to correct print quality defects such as banding and misregistration.

It is yet another advantage of the present invention that the method and apparatus provide for rotational alignment about a Z-axis for all print heads in the array, including the reference print head.

To achieve the foregoing and other aspects, features and advantages, and in accordance with the purposes of the present Invention as described herein, an adjustable print head module mounting and related method for automatically aligning multiple print head modules with respect to three axes of movement are provided. The mounting includes first and second means for positioning the print head module. The first means for positioning translates the print head module in an X-axis direction, while the second means for positioning translates the print head module in a Y-axis direction and rotates the print head module about a Z-axis. The related method includes the steps of printing a test image, analyzing the test image to determine print head module adjustments and aligning the multiple print head modules linearly with respect to the X- and Y-axes and rotationally with respect to the Z-axis.

Still other aspects of the present invention will become apparent to those skilled in this art from the following description, wherein there is shown and described a preferred embodiment of this invention by way of illustration of one of the modes best suited to carry out the invention. As it will be realized, the invention is capable of other different embodiments and its details are capable of modifications in various, obvious aspects all without departing from the invention. Accordingly, the drawings and descriptions will be regarded as illustrative in nature and not as restrictive. And now for a brief description of the drawings.

BRIEF DESCRIPTION OF THE DRAWINGS

FIG. 6*a* is a schematic representation of an angled column of printed pixels from the test pattern of FIG. 6, with one of the printed pixels displaced from its properly aligned position.

Reference will now be made in detail to the present preferred embodiment of the invention, an example of which is illustrated in the accompanying drawings.

DETAILED DESCRIPTION OF THE PREFERRED EMBODIMENT

Figure 1:
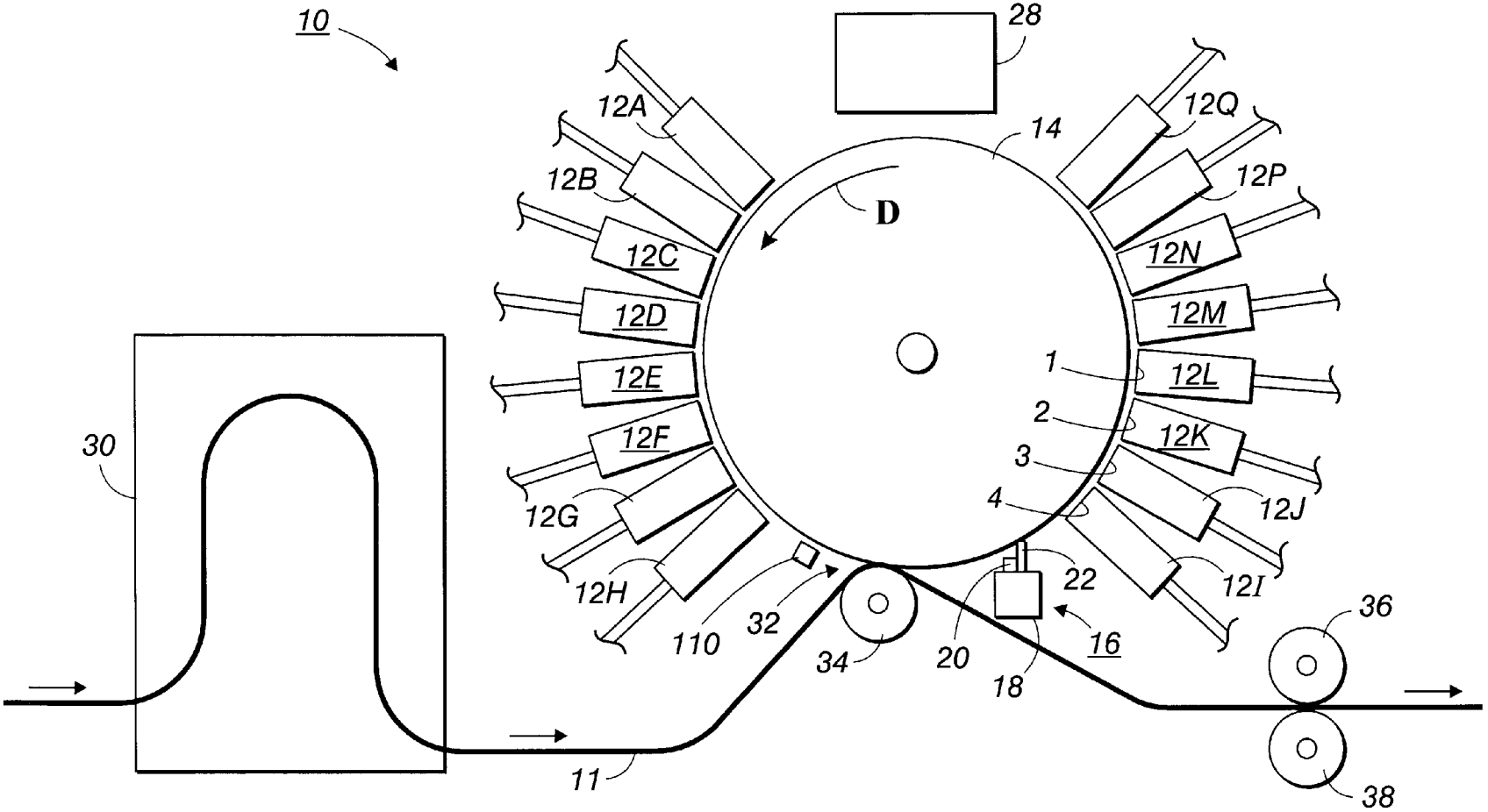
FIG. 1 is a diagrammatic illustration of a multiple print head offset ink jet printing apparatus that utilizes the apparatus and method of the present invention.

FIG. 1 is a schematic illustration of a multiple print head, offset or indirect ink jet printing apparatus 10 that utilizes the apparatus and method of the present invention. An example of an offset ink jet printer architecture is disclosed in U.S. Pat. No. 5,389,958 (the '958 patent) entitled IMAGING PROCESS and assigned to the assignee of the present application. The '958 patent is hereby specifically incorporated by reference in pertinent part.

The following description of a preferred embodiment of the present invention refers to its use in a multiple print head, offset printing apparatus. It will be appreciated, however, that the apparatus and method of the present invention may be used with various other ink-jet printing apparatus that utilize different architectures, such as direct printing in which ink is jetted directly onto a receiving medium. Accordingly, the following description will be regarded as merely illustrative of one embodiment of the present invention.

With continued reference to FIG. 1, the imaging apparatus 10 utilizes an offset printing process to place a plurality of ink drops in imagewise fashion on a final receiving substrate. In the preferred embodiment, the apparatus 10 includes 16 print head modules 12A–12N, 12P and 12Q positioned around a support surface or drum 14. The print head modules 12A–12N, 12P and 12Q jet drops of ink in a molten or liquid state onto an intermediate transfer surface (not shown) on the drum 14. The intermediate transfer surface is preferably a liquid layer that is applied to the drum 14 by contacting the drum with an applicator assembly 16. Suitable liquids that may be used as the intermediate transfer surface include water, fluorinated oils, glycol, surfactants, mineral oil, silicone oil, functional oils and combinations thereof. The preferred liquid is amino silicone oil.

The applicator assembly 16 includes a reservoir 18, a wicking pad 20 for applying the liquid and a metering blade 22 for consistently metering the liquid on the surface of the drum 14. Wicking pad 20 is preferably formed from any appropriate nonwoven synthetic textile with a relatively smooth surface. A preferred configuration can employ the smooth wicking pad 20 mounted atop a porous supporting material, such as a polyester felt. Both materials are available from BMP Corporation as BMP products NR 90 and PE 1100-UL, respectively.

The support surface may take the form of a drum 14 as shown in FIG. 1, or alternatively may be a belt, web, platen, or other suitable design. The support surface 14 may be formed from any appropriate material, such as metals including, but not limited to, aluminum, nickel or iron phosphate, elastomers, including but not limited to, fluoroelastomers, per fluoroelastomers, silicone rubber and polybutadiene, plastics, including but not limited to, polytetrafluoroethylene loaded with polyphenylene sulfide, thermoplastics such as polyethylene, nylon, and FEP thermosets such as acetals or ceramics. The preferred material is anodized aluminum.

Liquid or molten ink is ejected from the print head modules 12A–12N, 12P and 12Q onto the intermediate transfer surface on the drum 14 to form an ink image thereon. In the preferred embodiment, the ink utilized in the printer 10 is initially in solid form and is then changed to a molten state by the application of heat energy. The Intermediate transfer surface/drum 14 is maintained at a preselected temperature by a drum heater 28. On the intermediate transfer surface/drum 14 the ink cools and partially solidifies to a malleable state. The media 11 is fed through a preheater 30 and into a transfix nip 32 formed between the drum 14 and a transfer roller 34. The media 11 is shown as a continuous roll, but may also be individual sheets of media. As the media 11 passes through the nip 32, it is pressed against the deposited ink image to transfer and fix (transfix) the ink image to the media. Additional processing of the ink image on the media 11 may be accomplished by a pair of post-processing rollers 36, 38 downstream from the transfix nip 32. Preferably, all of the steps of depositing the ink image, heating the drum 14, preheating the media 11, applying the intermediate transfer surface to the drum 14, transfixing the ink image to the media, and post-processing the ink image on the media are performed simultaneously or in parallel to maximize printing speed.

Figure 2:
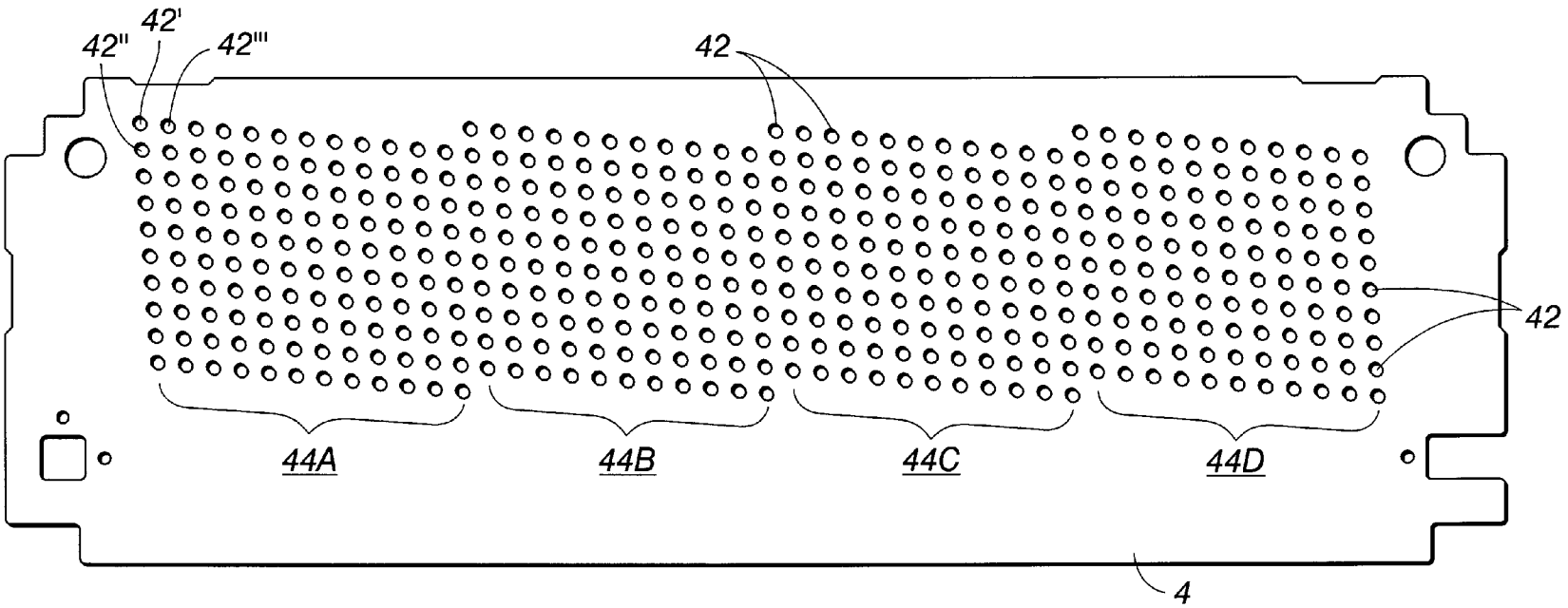
FIG. 2 is an enlarged elevational view of a print head module face plate having four arrays of ink jet nozzles for ejecting drops of ink.

With reference now to FIG. 2, each print head module 12A–12N, 12P and 12Q includes a face plate containing a plurality of nozzles 42 through which the liquid ink drops are ejected. The face plate 4 in FIG. 2 corresponds to the print head module 12I in FIG. 1. The following discussion of face plate 4 applies equally to the face plates on each of the other print head modules. In the preferred embodiment, face plate 4 includes four arrays 44A–44D of nozzles 42. Array 44A is 12 nozzles across by 10 nozzles high, while arrays 44B–44D are each 11 nozzles across by 10 nozzles high. This configuration yields a total of 450 nozzles 42 on the face plate 4.

As explained in more detail below, in the preferred embodiment the nozzles 42 are spaced apart vertically and horizontally by a distance of about 20 pixels, and each pixel has an approximate diameter or width of 1/300 inch (0.085 mm). The terms "horizontal" and "vertical" are used only in a general sense to indicate directions of reference, and should not be interpreted to refer to orthogonal directions. From the above description of the dimensions of the nozzle arrays 44A 44D, it will be appreciated that the face plate 4 can support 3 inch wide printing ((45 horizontal nozzles)× (1/15 inch between nozzles)=3 inches).

Figure 3:
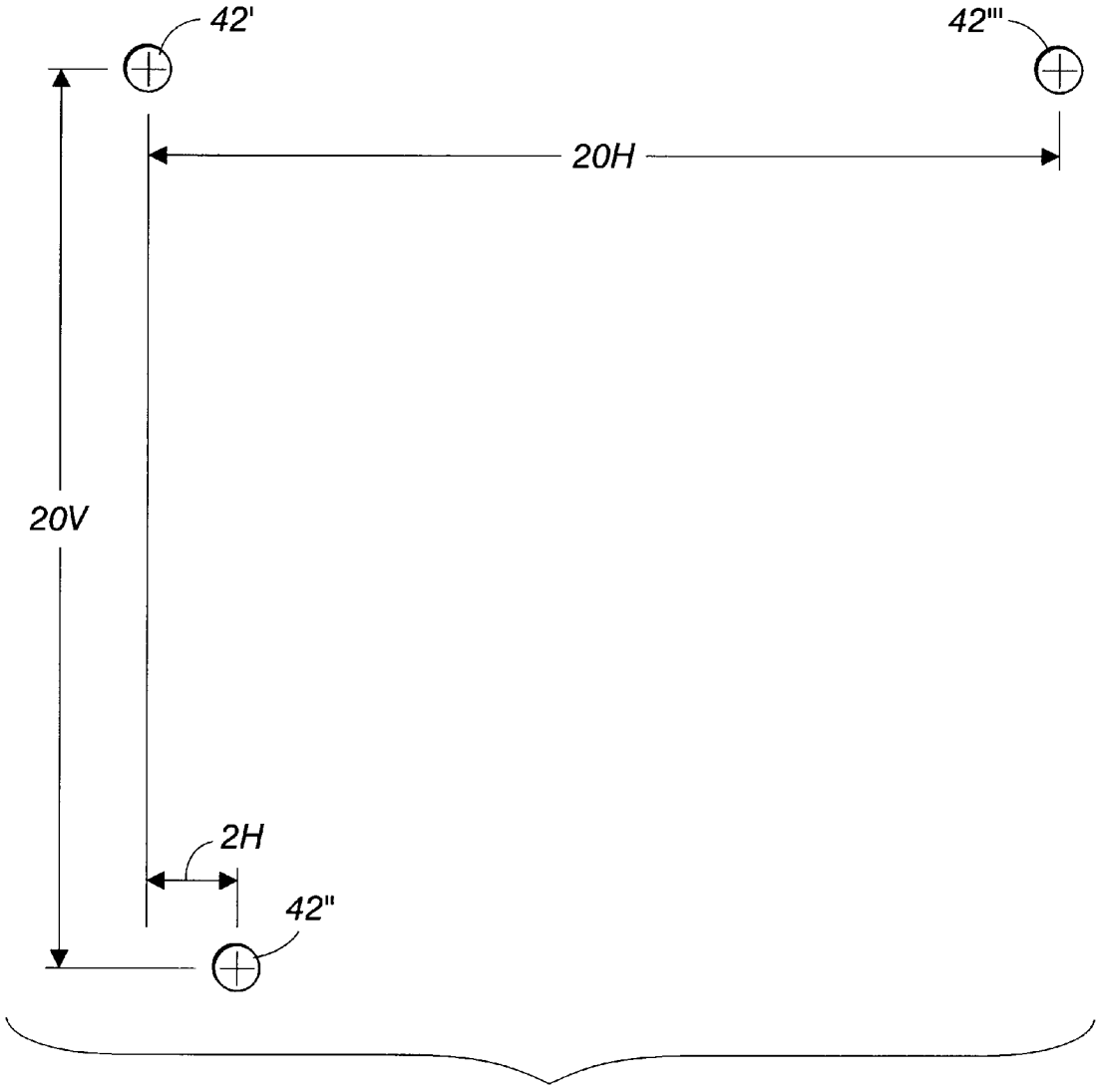
FIG. 3 is a greatly enlarged illustration showing the spacing between two horizontally adjacent nozzles and two vertically adjacent nozzles on the face plate.

FIG. 3 is a greatly enlarged illustration of horizontally adjacent nozzles 42' and 42''' and vertically adjacent nozzles 42' and 42''. It will be appreciated that the relative placement of nozzles 42', 42'' and 42''' is representative of the relative placement of any vertically or horizontally adjacent nozzles 42 on the face plate 4. As shown in FIG. 3, the horizontal centerline-to-centerline distance 20H between horizontally adjacent nozzles 42' and 42''' is 20 pixels. As discussed above, a pixel represents a single dot location within an image. The size or dimensions of a pixel will vary depending on the resolution of the image. The preferred embodiment described herein refers to printing at 300 dpi (118 dots per cm.), or 300 pixels per inch. Thus, each pixel will have an approximate diameter or width of 1/300 inch (0.085 mm.), and the above-referenced horizontal distance 20H of 20 pixels is equal to 1/15 inch.

With continued reference to FIG. 3, the vertical centerline-to-centerline distance 20V between vertically adjacent nozzles 42' and 42'' is 20 pixels, or 1/15 inch. As shown in FIGS. 2 and 3, the vertical rows of nozzles 42 are angled slightly. Preferably, the horizontal centerline-to-centerline distance 2H between vertically adjacent nozzles 42 is 2 pixels, or 1/150 inch. Alternatively expressed, vertically adjacent nozzles are offset by 2 pixels, or 1/150 inch.

With reference now to FIGS. 1 and 2, as the drum 14 moves past the face plate 4 of print head module 12I, the nozzles 42 are selectively fired to place ink drops on the intermediate transfer surface on the drum. Given that vertically adjacent nozzles are horizontally offset by 2 pixels, a horizontal line printed by face plate 4 would have one pixel gaps between each printed pixel. Thus, to enable the printer 10 to print solid fill images, a second face plate 2 corresponding to print head module 12K is horizontally aligned to interleave with face plate 4 (See FIG. 4).

Figure 4:
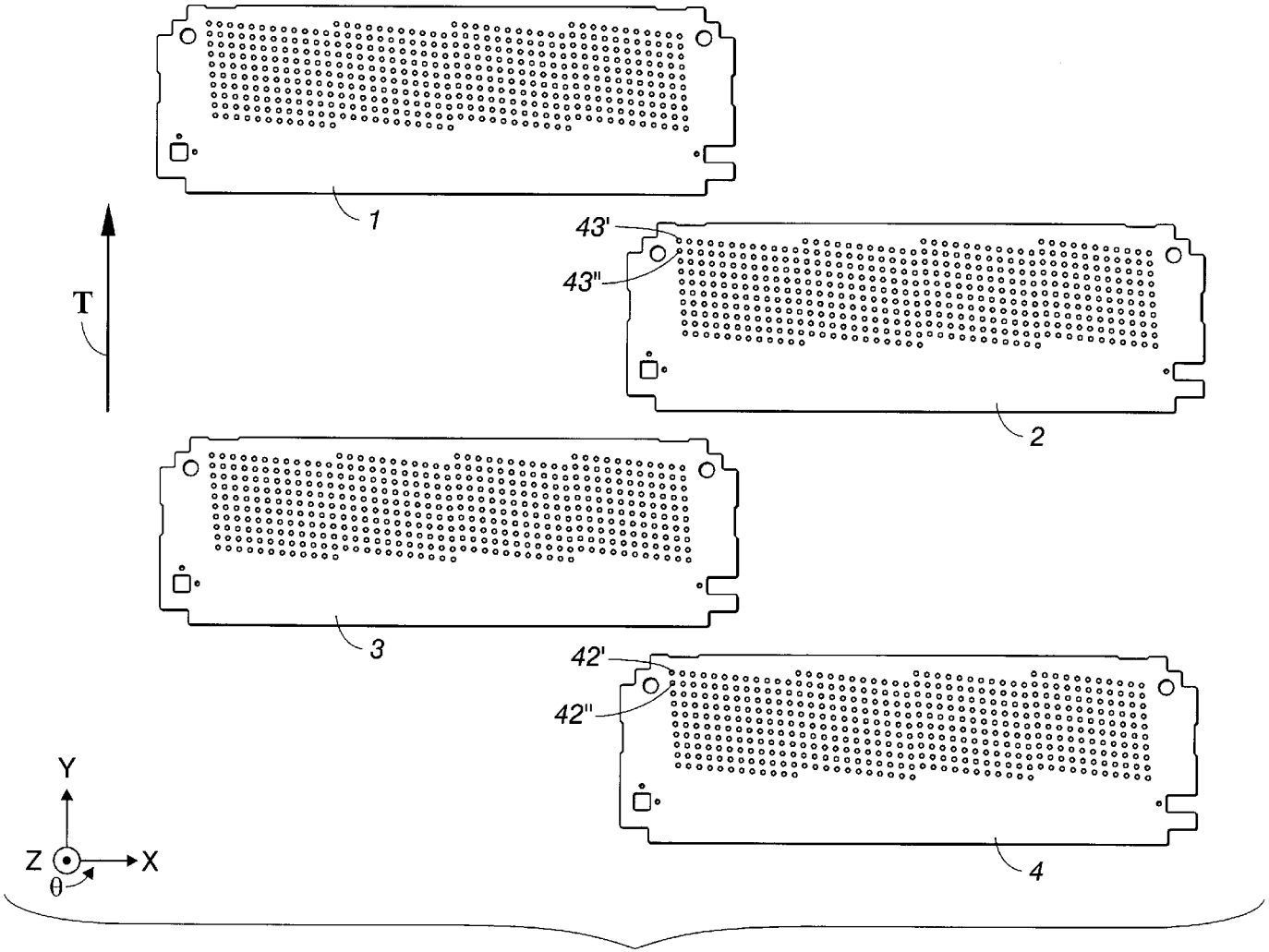
FIG. 4 is an elevational view of four face plates that are positioned to eject drops of ink that interleave with one another to form a solid fill image.
Figure 5:
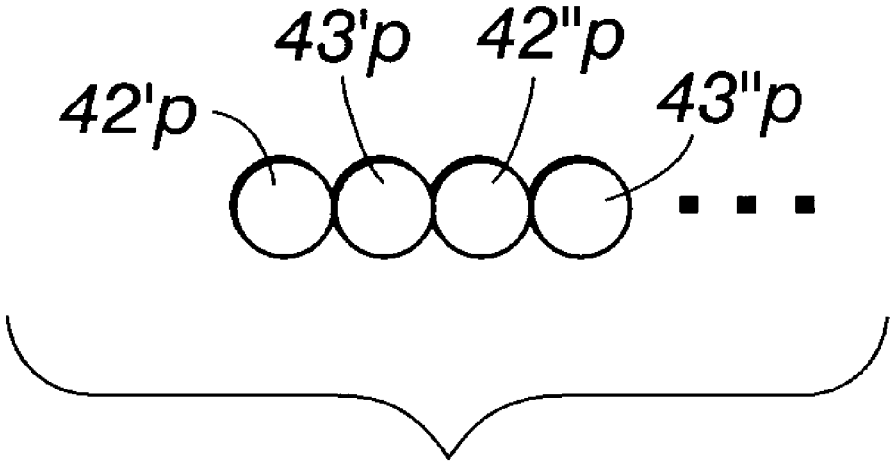
FIG. 5 is a schematic representation of a portion of a horizontal line printed by face plates 4 and 2 in FIG. 4.

More specifically, with reference to FIGS. 4 and 5, the nozzles in face plates 4 and 2 are horizontally offset by one pixel such that the one pixel gaps between vertically adjacent nozzles in face plate 4 are filled by the nozzles in face plate 2. FIG. 5 illustrates a portion of a horizontal line printed by face plates 4 and 2. Pixel 42'p is printed by nozzle 42' of face plate 4, pixel 43'p is printed by nozzle 43' of face plate 2, pixel 42''p is printed by nozzle 42'' of face plate 4, pixel 43''p is printed by nozzle 43'' of face plate 2, and so forth.

As explained above, in the preferred embodiment each print head module/face plate is capable of 3 inch wide printing. A pair of horizontally aligned face plates, such as face plates 4 and 2, supports 3 inch wide printing at 300 dpi. With reference to FIG. 4, to enable the printer 10 to print 6 inch wide solid fill images, a second pair of horizontally aligned face plates 3 and 1, corresponding to print head modules 12J and 12L, respectively, are interleaved with face plates 4, 2. Preferably, the bottom four nozzles in the far right vertical row of face plates 3 and 1 interleave with the top four nozzles in the far left vertical row of face plates 4 and 2, respectively.

With reference now to FIGS. 1 and 4, in the preferred embodiment the printer 10 utilizes four colors of ink, cyan, magenta, yellow and black, for full color printing. Two interleaved pairs of print modules/face plates, such as face plates 4, 3, 2 and 1, are dedicated to each of the four colors.

Thus, the printer 10 includes four sets of two interleaved pairs of print modules/face plates for a total of 16 print modules/face plates. The four sets of interleaved print modules/face plates are aligned horizontally to print full color, 6 inch wide images. It will be appreciated that any number of print head modules/face plates may be interleaved to allow for greater image widths. For example, four pairs of print head modules/face plates may be interleaved for each color to support 12 inch wide printing.

As discussed above, it is important to maintain proper alignment among the multiple print head modules to insure proper image quality. If one print head module is misaligned relative to another print head module, printing artifacts such as banding and misregistration can occur. Additionally, if a print head module is removed and reinstalled or replaced, the newly installed print head module must be aligned with the other print head modules, either manually by the operator or automatically. Accordingly, in an important aspect of the present invention, a method and apparatus for automatically aligning multiple print head modules will now be described.

The method of the present invention for automatically aligning multiple print head modules is based on the general concept of printing and analyzing a test pattern to determine whether the print head modules require repositioning. In an important and novel aspect of the present invention, the present method automatically aligns the print head modules with respect to three axes of movement. Additionally, as explained in more detail below, the method utilizes a single means for positioning a print head module to align the module with respect to two different axes of movement.

Figure 6:
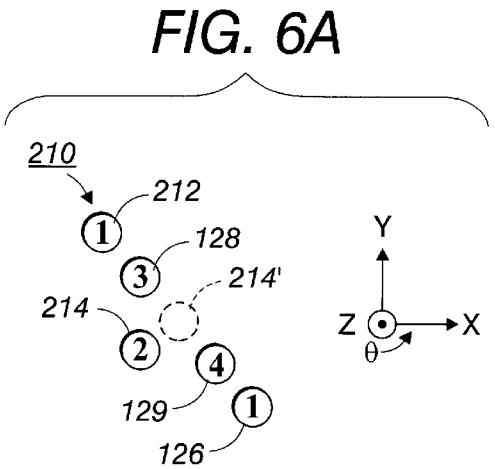
FIG. 6 is a schematic representation of a portion of a horizontal line comprised of Interleaved printed pixels from face plates 1, 2, 3 and 4 of FIG. 4, and a test pattern that includes printed pixels from each of the four face plates.
Figure 6:
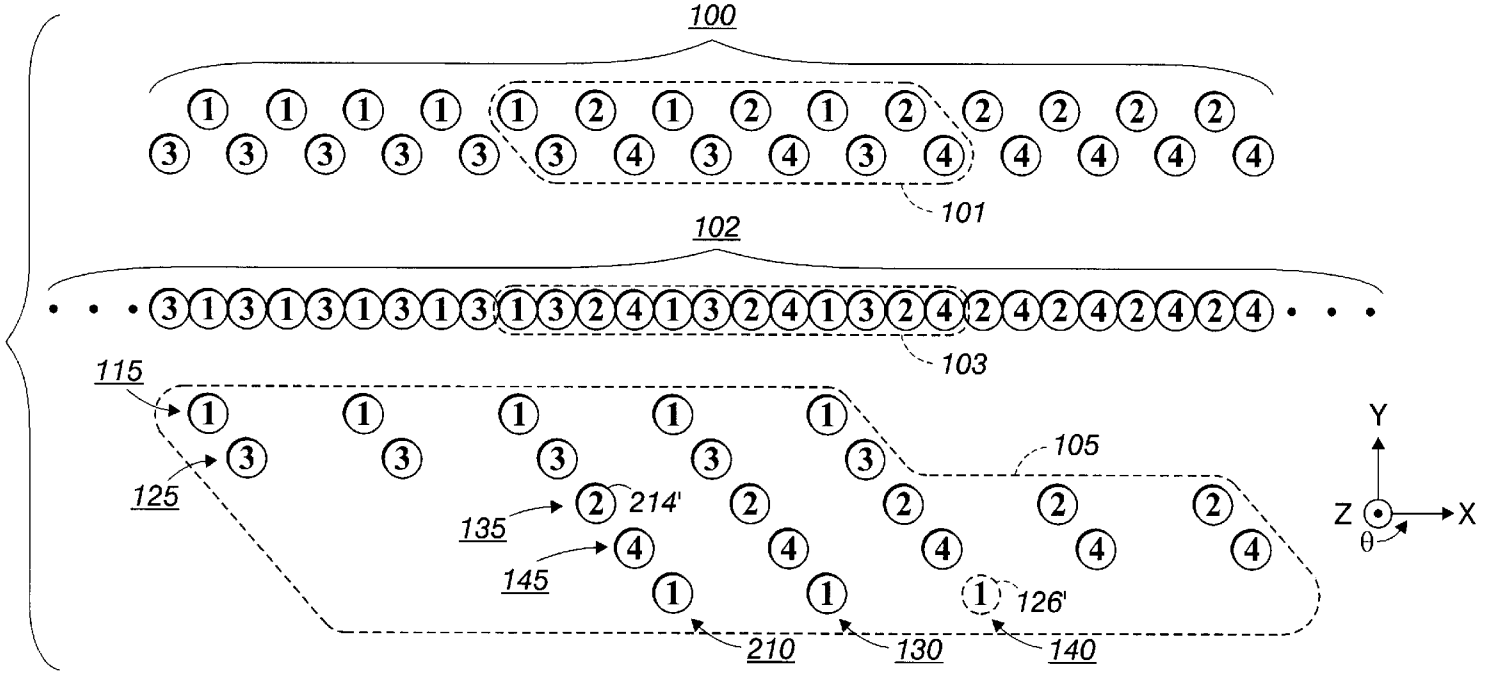

The printing of the test pattern will first be described. With reference to FIGS. 4 and 6 and as described above, printed pixels from face plates 1, 2, 3 and 4 may be interleaved to form a solid fill horizontal line. A greatly enlarged portion 102 of such a line is illustrated in FIG. 6. Each circle in line portion 102 represents one printed pixel, and the number inside the circle corresponds to the face plate that jetted that printed pixel. To better illustrate the interleaving of printed pixels, the array 100 of printed pixels shows a vertically staggered breakdown of line portion 102, with the pixels from face plates 1 and 2 shown above the pixels from face plates 3 and 4. Additionally, groupings 101 in array 100 and 103 in line portion 102 contain printed pixels from each of the four face plates 1, 2, 3 and 4. These groupings of printed pixels represent the interleaved portion or "seam" in a solid fill horizontal line that is printed using nozzles from all four face plates 1, 2, 3 and 4.

With continued reference to FIG. 6, the test pattern 105 utilized by the method of the present invention is illustrated below line portion 102. The test pattern 105 includes printed pixels from each of the four face plates 1, 2, 3 and 4. With reference to FIG. 1, a test pattern 105 (not shown) is printed on the intermediate transfer surface on the drum 14 by print head modules 12I–12L. As the drum rotates in the direction of action arrow D, the printed test pattern 105 Is advanced past an optical sensor 110. An example of a suitable optical sensor is a contact image sensor from Dyna Image Corp., model number DL107-34AM.

Figure 7:
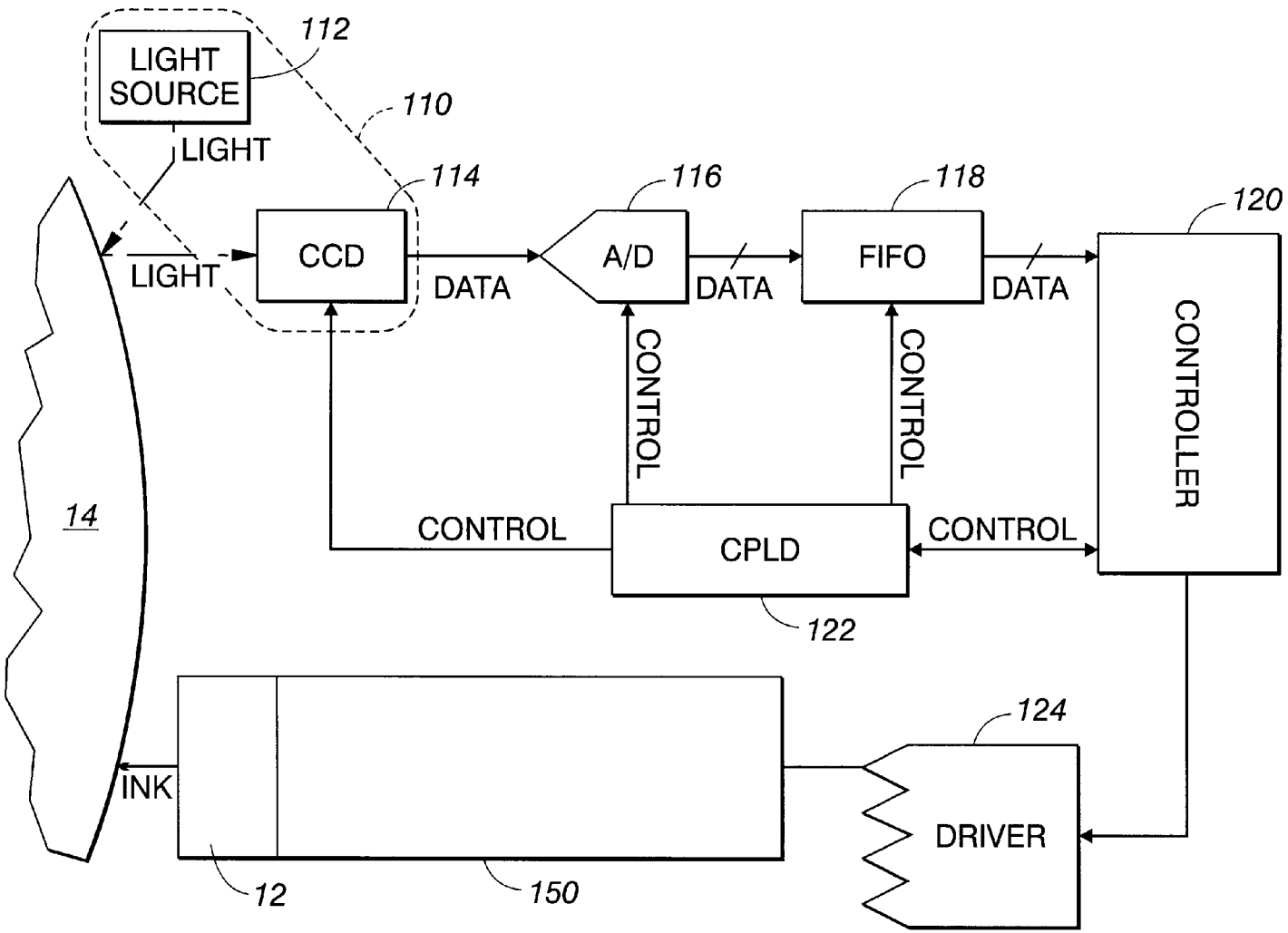
FIG. 7 is a simplified block diagram showing the flow of data and information from an optical sensor to an adjustable print head module.

With reference now to FIG. 7, the optical sensor 110 directs light from a light source 112 onto the drum 14 to illuminate the test pattern 105. The light scattered from the test pattern 105 is received by a charge coupled device (CCD) 114 within the sensor 110 and focused onto a silicon sensor array (not shown). Data from the sensor array represents the positions of the printed pixels within the test pattern 105. As described in more detail below, this data is then analyzed to determine whether one or more of the print head modules 12I–12L requires repositioning.

With continued reference to FIG. 7, in the preferred embodiment data from the CCD 114 is transferred serially to an analog-to-digital converter (A/D) 116. A suitable A/D converter is available from Harris-Hill Co, model number TDC1175-30. The A/D 116 transforms the voltage signal coming from the CCD 114 into 8 bit binary samples. These samples are then transferred into a FIFO memory 118 before being sent to the controller 120 for processing. A suitable FIFO memory is model number AM7202 available from AMD, Inc. The preferred controller is an i486 controller available from Intel. The FIFO memory 118 decouples the scanning rate of the sensor 110 from the speed that the controller 120 can accept and process the data. Additionally, a complex programmable logic device (CPLD) 122, such as model number ispLSI2032 available from Lattice Semiconductor, generates control and timing signals for the sensor 110, the A/D converter 116, the FIFO memory 118 and the controller 120.

Upon determining that a selected print head module requires repositioning, the controller 120 sends position information to a driver 124. A suitable driver is the Mini SSC manufactured by Scott Edwards Electronics, model number 27912. The driver 124 transforms the position information into control signals that are used to reposition a print head mounting 150 that supports the selected print head module. The print head mounting is described in more detail below.

Returning to FIGS. 4 and 6, movement of the print head modules/face plates 1–4 and the positions of the printed pixels in the test pattern 105 will be discussed relative to an X-Y-Z coordinate system. The X-axis refers to a direction perpendicular to the drum travel direction T past a print head module, the Y-axis refers to a direction parallel to the drum travel direction T and the Z-axis refers to a direction perpendicular to the X-Y plane. With respect to the illustrations in FIGS. 4 and 6, the X-axis corresponds to a horizontal axis, the Y-axis corresponds to a vertical axis and the Z-axis corresponds to an axis coming out of the paper toward the reader.

It will be appreciated that in this three dimensional coordinate system, a print head has six degrees of freedom of movement - three degrees of freedom of translation along the X, Y and Z axes, and three degrees of freedom of rotation about the three axes. In an important aspect of the present invention, the print head modules/face plates are aligned relative to one another with respect to their position along the X- and Y-axes and individually aligned with respect to their angular rotation or roll about the Z-axis.

An example of analyzing the test pattern 105 to determine whether a selected print head module requires repositioning with respect to the X- and Y-axes will now be described. A reference print head module is first selected. In an important aspect of the present invention, the reference print head module is maintained in a fixed position while the other non-reference print head modules are aligned with respect to the reference print head module. In a separate step discussed below, the angular rotation about the Z-axis of each of the print head modules, including the reference print head module, is analyzed and corrected when appropriate.

For purposes of this example, print head module 12L in FIG. 1, corresponding to face plate 1 in FIG. 4, is selected as the reference print head module. With reference to FIG. 6, printed pixels from face plate 1 are indicated by circles enclosing the number 1. To determine whether one or more of the other three non-reference print head modules 12K, 12J and 12I, corresponding to face plates 2, 3 and 4, respectively, require repositioning along the X- and/or Y-axis, the positions of printed pixels from these other three print head modules are analyzed with respect to printed pixels from the reference print head module 12L in test pattern 105.

The test pattern 105 in FIG. 6 illustrates generally the output of four print head modules that are properly aligned relative to one another. It will be appreciated that in angled columns 210, 130 and 140, the printed pixels lie on an imaginary line (not shown) extending between the printed pixels ejected from the reference print head module 12L/face plate 1. In FIG. 6*a,* one angled column 210 of printed pixels from the test pattern 105 is shown with the printed pixel 214 from print head module 12K/face plate 2 displaced from its properly aligned position 214'. To align print head module 12K with the reference print head module 12L, first and second distances along the X- and Y-axes, respectively, between the actual position of printed pixel 214 and its properly aligned position 214' on the imaginary line are calculated. With the first distance along the X-axis calculated, a first means for positioning in the print head mounting 150, described in more detail below, translates the print head module 12K along the X-axis by the calculated distance. Similarly, a second means for positioning in the print head mounting 150 translates the print head module 12K along the Y-axis by the second calculated distance. In this manner, the selected print head module 12K is aligned with the reference print head module 12L.

In a situation where the printed pixel 214 is located along the imaginary line extending between the reference printed pixels 212, 126, the method determines whether the printed pixel 214 is equidistant from adjacent printed pixels 128, 129 along the imaginary line. If the printed pixel 214 is not equidistant from the adjacent pixels 128, 129, a third distance along the imaginary line is calculated between the printed pixel 214 and the properly aligned position 214' along the imaginary line.

The same analyses are performed on angled columns 130 and 140 for the printed pixel from face plate 2. The results from the three angled columns 210, 130, and 140 are averaged to obtain an average deviation of the print head module 12K/face plate 2 from its properly aligned position with respect to the reference print head module 12L. The first and second means for positioning in the print head mounting 150 then translate the selected print head module 12K along the X- and Y-axes to align it with the reference print head module 12L.

It should be noted that in angled column 140 the printed pixel 126' is shown in dotted outline to indicate that this is not an actual printed pixel in the test pattern 105. Printed pixel 126' is a theoretical projection of where a printed pixel from the reference print head module 12L/face plate 1 would be located in column 140. This projection of printed pixel 126' allows angled column 140 to be completed and utilized to align the non-reference print head modules.

The above steps are performed to align the other two non-reference print head modules 12I and 12J with the reference print head module 12L. Upon aligning these other two non-reference print head modules, the four print head modules are now properly aligned relative to one another.

The process of aligning each of the print head modules, including the reference print head module, with respect to its angular rotation about the Z-axis will now be described. To perform this alignment, a horizontal row of printed pixels from a single print head module is analyzed. With continued reference to FIG. 6, horizontal row 115 consists of five printed pixels from print head module 12L/face plate 1. These five printed pixels are analyzed to determine if they are equidistant along the X-axis. If they are not, the method calculates an amount and a direction of rotation of print head module 12L about the Z-axis that will cause the print head module 12L to eject ink drops that are equidistant along the X-axis. The same procedure is utilized to analyze horizontal rows 125, 135 and 145 and align print head modules 12J, 12K and 12I, respectively, with respect to their angular rotation about the Z-axis. It will be appreciated that this method of aligning a single print head with respect to its angular position about the Z-axis is equally applicable to single print head printing systems.

With reference to FIG. 1, while the above-described steps have been described with respect to aligning four print head modules corresponding to a single color, the method of the present invention may also be utilized to align all of the print head modules 12A–12N, 12P and 12Q to insure that all four colors are properly registered. For example, a first test pattern may be printed utilizing one print head module from each of the four groupings of four print head modules. Once these four print head modules are aligned, four more test patterns are printed, one for each color grouping of print head modules. The print head module in each grouping that was aligned with the first test pattern is designated the reference print head module, and the other three print head modules in each grouping are aligned with respect to the reference print head module as described above.

Print Head Module Mounting

Figure 8:
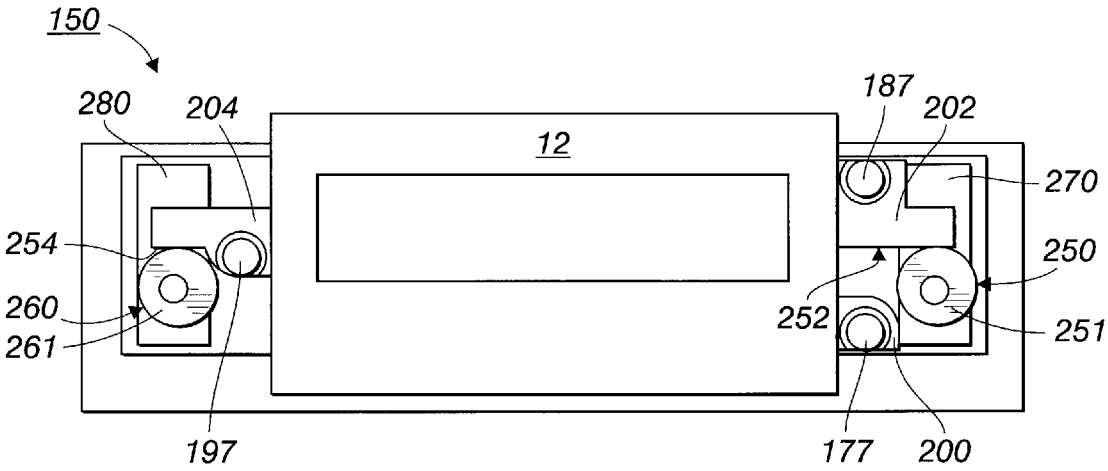
FIG. 8 is a front elevational view of an adjustable mounting for a print head module.
Figure 9:
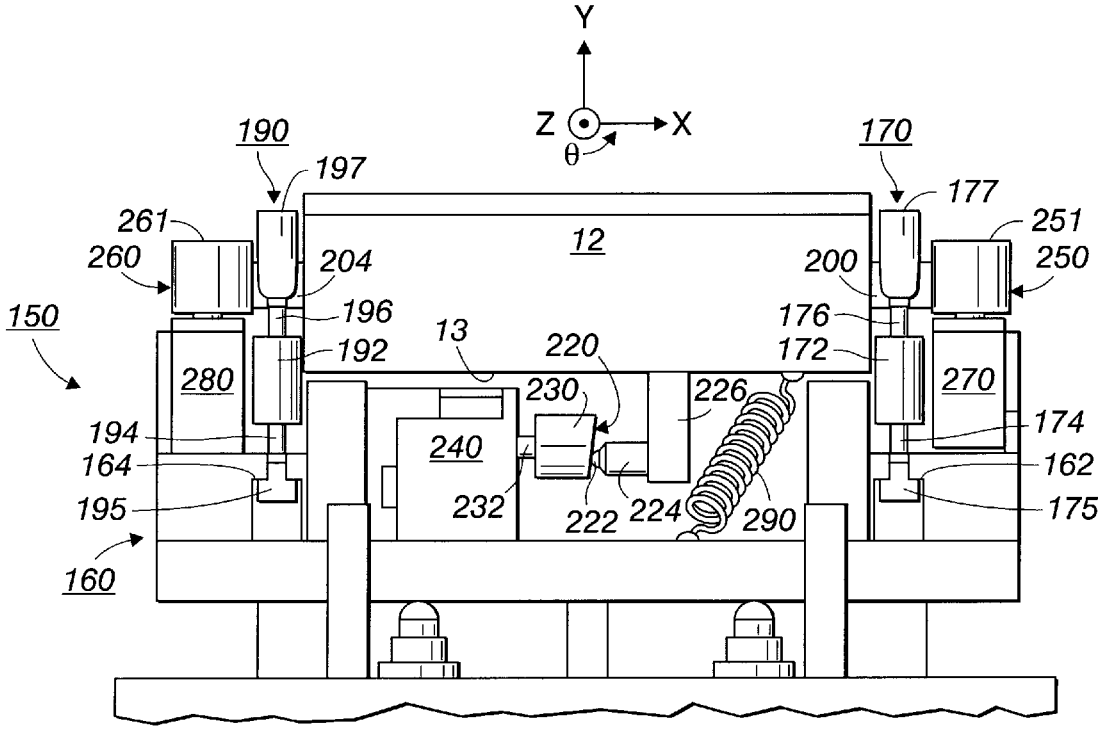
FIG. 9 is a bottom elevational view of the adjustable mounting for a print head module of FIG. 8.

With reference now to FIGS. 8 and 9, a mounting 150 for supporting and aligning a print head module 12 with respect to three axes of movement will now be described. The mounting 150 includes a base 160 and at least one flexure extending from the base for supporting the print head module 12. In the preferred embodiment, three parallel adjustable support members 170, 180 and 190 extend from the base to support the print head module 12 (see also FIG. 10). Each support member 170, 180 and 190 is pivotally coupled at each end to the base 160 and to a flange extending from the print head module 12. Advantageously, this allows the print head module to be positioned with respect to three degrees of freedom of movement, translation along the X- and Y-axes and rotation about the Z-axis, while also preventing significant movement in the other three degrees of freedom of movement.

Each support member 170, 180 and 190 includes a threaded connector 172, 182, 192, respectively. As shown in FIG. 9, arms 174, 176 extend from threaded connector 172. A first plug 175 is affixed to the end of arm 174 and a second plug 177 is affixed to the end of arm 176. The first plug 175 is pivotally coupled to a shoulder 162 in the base 160. The second plug 177 is pivotally coupled to a flange 200 extending from the print head module 12.

Figure 10:
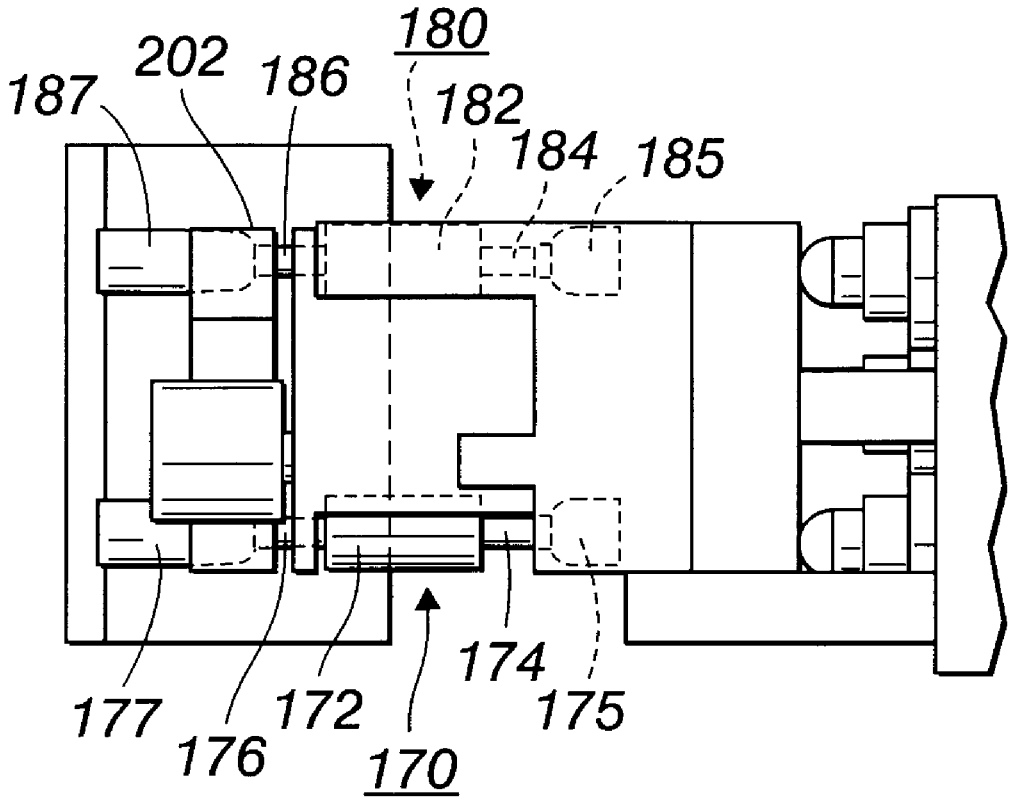
FIG. 10 is a right side elevational view of the adjustable mounting for a print head module of FIG. 8.

With reference now to FIG. 10, arms 184, 186 extend from threaded connector 182. A first plug 185 is affixed to the end of arm 184 and a second plug 187 is affixed to the end of arm 186. The first plug 185 is pivotally coupled to a shoulder (not shown) in the base 160. The second plug 187 is pivotally coupled to a flange 202 extending from the print head module 12.

With reference now to FIG. 9, arms 194, 196 extend from threaded connector 192. A first plug 195 is affixed to the end of arm 194 and a second plug 197 is affixed to the end of arm 196. The first plug 195 is pivotally coupled to a shoulder 164 in the base 160. The second plug 197 is pivotally coupled to a flange 204 extending from the print head module 12.

It will be appreciated that other flexures or supporting means may be utilized to support the print head module, such as one or more springs, solid posts, cables, and the like.

In an important aspect of the present invention, the mounting includes a first means for positioning the print head module along a first axis of movement and a second means for positioning the print head module along a second axis of movement and about a third axis of movement. In the preferred embodiment shown in FIG. 9, the first means for positioning comprises a first camming surface 220 that engages a first control surface 222. The first control surface 222 is positioned at the end of a lateral extension 224 that extends from a flange 226. The flange 226 extends from a rear face 13 of the print head module 12.

As best seen in FIG. 9, the first camming surface 220 is a sloping end portion of a rotatable cam 230. The rotatable cam 230 is connected by shaft 232 to a servo motor 240 for rotating the first camming surface 220. In this manner, when the servo motor 240 is actuated to rotate the first camming surface 220, the first control surface 222 and connected print head module 12 are translated in an X-axis direction.

In an important aspect of the present invention, the second means for positioning the print head module moves the print head module with respect to two different axes of movement—translation along the Y-axis and rotation about the Z-axis. With reference to FIGS. 8 and 9, in the preferred embodiment the second means for positioning comprises a second camming surface 250 that engages a second control surface 252 on flange 202, and a third camming surface 260 that engages a third control surface 254 on flange 204. The second camming surface 250 is the periphery of a cylinder 251, and the third camming surface 260 is the periphery of a cylinder 261.

Both cylinders 251 and 261 are mounted for eccentric rotation by servo motors 270 and 280, respectively. With reference to FIG. 8, simultaneous rotation of second camming surface 250 and third camming surface 260 causes the print head module 12 to move in a Y-axis direction. Alternatively, rotation of second camming surface 250 while maintaining third camming surface 260 stationary, or rotation of third camming surface 260 while maintaining second camming surface 250 stationary, results in rotating the print head module 12 about the Z-axis. Advantageously, the two camming surfaces 250, 260 and their associated servo motors 270, 280 allow for alignment of the print head module with respect to two different axes of movement.

With reference now to FIG. 9, a coil spring extends upwardly from the base 160 to the rear face 13 of the print head module 12. The spring 290 is preferably in tension, such that it urges the first control surface 222 against the first camming surface, the second control surface 252 against the second camming surface 250 and the third control surface 254 against the third camming surface 260. Advantageously, this insures that movement of any of the camming surfaces results in the desired movement of the print head module 12.

It will be appreciated that other means for positioning the print head module may be utilized to practice the present invention, such as various combinations of stepper motors, d.c. motors and piezoelectric actuators with lead screws, levers and cams.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A method of automatically aligning a selected print head module with respect to three axes of movement to improve image quality in an ink jet print, the selected print head module being one of a plurality of print head modules in the ink jet printer, the print head modules being stationary during printing operations, the method comprising the steps of:

a) printing a test pattern on a receiving substrate by ejecting ink drops from the plurality of print head modules onto the receiving substrate;

b) designating a reference print head module from the plurality of print head modules;

c) analyzing the test pattern to determine whether the selected print head module requires repositioning with respect to the reference print head module;

d) translating the selected print head module along a first axis of movement to align the selected print head module with the reference print head module, wherein the first axis of movement is in a direction parallel to the direction of print media travel;

e) translating the selected print head module along a second axis of movement to align the selected print head module with the reference print head module, wherein the second axis of movement is in a direction perpendicular to the direction of print media travel; and f) rotating the selected print head module about a third axis of movement to align the selected print head module with respect to the first axis of movement and the second axis of movement, wherein the third axis is perpendicular to the first and second axes.

2. The method of claim 1, wherein the step of printing the test pattern further comprises the steps of:

printing at least one grouping of ink drops;

including in the grouping ink drops from each of the plurality of print head modules; and including in the grouping at least two reference ink drops from the reference print head module.

3. The method of claim 2, wherein the step of analyzing the test pattern further comprises the steps of:

establishing a plurality of evenly-spaced properly aligned positions between the reference ink drops in the grouping, each of the properly aligned positions corresponding to one of the plurality of print head modules;

analyzing the grouping to determine whether a selected ink drop ejected from the selected print head module is in the properly aligned position corresponding to the selected print head module; and if not, calculating a first distance along the first axis and a second distance along the second axis between the selected ink drop and the properly aligned position corresponding to the selected print head module.

4. The method of claim 3, wherein the step of analyzing the test pattern further comprises the steps of:

determining whether the selected ink drop is equidistant from adjacent ink drops in the grouping, the adjacent ink drops being ejected from two other print head modules from among the plurality of print head modules; and if not, calculating a third distance between the selected ink drop and the properly aligned position corresponding to the selected print head module.

5. The method of claim 4, further comprising the steps of:

analyzing the test pattern to determine whether a plurality of ink drops ejected from the selected print head module are equidistant along the first axis; and if not, calculating an amount and a direction of rotation of the selected print head module that causes the selected print head module to eject ink drops that are equidistant along the first axis.

6. The method of claim 5, wherein the step of translating the selected print head module along the first axis of movement further comprises the step of rotating a first camming surface to move a first control surface connected to the selected print head module.

7. The method of claim 6, wherein the step of translating the selected print head module along the second axis further comprises the steps of:

rotating a second camming surface to move a second control surface connected to the selected print head module; and rotating a third camming surface to move a third control surface connected to the selected print head module.

8. The method of claim 7, wherein the step of rotating the selected print head module about the third axis further comprises the step of rotating the selected print head module about the third axis which is orthogonal to the first axis and to the second axis.

9. The method of claim 8, wherein the step of rotating the selected print head module about the third axis further comprises the step of rotating the second camming surface while maintaining the third camming surface stationary, or rotating the third camming surface while maintaining the second camming surface stationary.

10. The method of claim 9, further comprising the step of maintaining the reference print head module in a fixed position.

11. The method of claim 1, further comprising the steps of:

using a first means for positioning to translate the selected print head module along the first axis of movement;

using a second means for positioning to translate the selected print head module along the second axis of movement; and using the second means for positioning to rotate the selected print head module about the third axis of movement.

12. The method of claim 11, wherein the step of analyzing the test pattern further comprises the step of sensing with an optical sensor positions of the ink drops.

13. The method of claim 12, further comprising the step of performing steps a) through f) for a plurality of selected print head modules.

14. The method of claim 13, wherein the step of printing a test pattern further comprises the step of ejecting the plurality of ink drops from the plurality of print head modules onto an intermediate transfer surface in an offset ink jet printer.

15. A method of automatically aligning a selected print head module with respect to first, second and third axes of movement and automatically aligning a reference print module about the third axis of movement to improve image quality in an ink jet printer, the selected and reference print head modules being stationary during printing operations, the method comprising the steps of:

a) printing a test pattern on a receiving substrate by ejecting ink drops from the selected print head module and from the reference print head module onto the receiving substrate;

b) analyzing the test pattern to determine whether the selected print head module requires repositioning with respect to the reference print head module;

c) analyzing the test pattern to determine whether the reference print module requires repositioning about the third axis of movement;

d) translating the selected print head module along the first axis of movement to align the selected print head module with the reference print head module, wherein the first axis of movement is in a direction perpendicular to the direction of print media travel;

e) translating the selected print head module along the second axis of movement to align the selected print head module with the reference print head module, wherein the second axis of movement is in a direction parallel to the direction of print media travel;

f) rotating the selected print head module about the third axis of movement to align the selected print head module with respect to the first axis of movement and the second axis of movement, wherein the third axis of movement is perpendicular to the first and second axes of movement; and g) rotating the reference print head about the third axis of movement to align the reference print head module with respect to the first axis of movement and the second axis of movement.

16. The method of claim 15, further comprising the steps of:

using a first means for positioning to translate the selected print head module along the first axis of movement;

using a second means for positioning to translate the selected print head module along the first axis of movement; and using the second means for positioning to rotate the selected print head module about the third axis of movement.

17. A method of automatically aligning a print head with respect to its angular position about a first axis of movement to improve image quality in an ink jet printer, the method comprising the steps of:

a) printing a test pattern on a receiving substrate by ejecting a plurality of ink drops from the print head onto the receiving substrate;

b) determining whether the plurality of ink drops are equidistant along a second axis of movement;

c) calculating an amount and direction of rotation of the print head about the first axis of movement that causes the print head to print the test pattern with ink drops that are equidistant along the second axis of movement; and d) rotating the print head about the first axis of movement to align the print head with respect to its angular position about the first axis of movement, wherein the first axis of movement is perpendicular to an axis of movement in a direction perpendicular to the direction of print media travel and perpendicular to an axis of movement parallel to the direction of print media travel.

18. A mounting for supporting and aligning a print head module with respect to three axes of movement, the print head module operating to jet ink onto a receiving substrate, the mounting comprising:

a base;

at least one flexure extending from the base to the print head module;

first means for positioning the print head module along a first axis of movement, wherein the first axis of movement is in a direction parallel to the direction of print media travel; and second means for positioning the print head module along a second axis of movement, wherein the second axis of movement is in a direction perpendicular to the direction of print media travel and for rotating the print head module about a third axis of movement, wherein the third axis of movement is perpendicular to the first axis of movement and the second axis of movement.

19. The mounting of claim 18, wherein the first means for positioning comprises:

a first camming surface engaging a first control surface connected to the print head module; and a means for rotating the first camming surface to impart translational movement along the first axis of movement to the print head module.

20. A mounting for supporting and aligning a print head module with respect to three axes of movement, the print head module operating to jet ink onto a receiving substrate, the mounting comprising:

a base;

at least one flexure extending from the base to the print head module;

first means for positioning the print head module along a first axis of movement, wherein the first means for positioning comprises: a first camming surface engaging a first control surface connected to a print head module; and means for rotating the first camming surface to impart translational movement along the first axis of movement to the print head module; and second means for positioning the print head module along a second axis of movement, and about a third axis of movement, wherein the second means for positioning comprises:

a second camming surface engaging a second control surface connected to a first end of the print head module;

a third camming surface engaging a third control surface connected to a second end of the print head module substantially opposite to the first end;

a means for rotating the second camming surface to impart to the print head module translational movement along the second axis of movement and rotational movement about the third axis of movement; and a means for rotating the third camming surface to impart to the print head module translational movement along the second axis of movement and rotational movement about the third axis of movement.

21. The mounting of claim 20, wherein the first camming surface is a sloping end portion of a first rotatable cam.

22. The mounting of claim 21, wherein the second and third camming surfaces are each a periphery of a cylinder mounted for eccentric rotation.

23. The mounting of claim 22, wherein the print head module includes a first flange, and wherein the at least one flexure comprises a first adjustable support member that is pivotally coupled to the base and pivotally coupled to the first flange.

24. The mounting of claim 23, wherein the print head module includes a second flange, and further comprising a second adjustable support member that is pivotally coupled to the base and pivotally coupled to the second flange.

25. The mounting of claim 24, further including a biaser extending between the base and the print head module in a direction that urges the first control surface against the first camming surface, the second control surface against the second camming surface and the third control surface against the third camming surface.

26. The mounting of claim 25, wherein the print head module jets ink onto an intermediate transfer surface in an offset ink jet printer to form an image.

* * * * *